United States Patent [19]

McVean et al.

[11] Patent Number: 4,781,377

[45] Date of Patent: Nov. 1, 1988

[54] HYBRID SPORTING EVENT AND GAME SHOW

[76] Inventors: Charles D. McVean; David R. Kime, both of McVean & Company, 850 Ridge Lake Blvd., Suite G01, Memphis, Tenn. 38119

[21] Appl. No.: 922,842

[22] Filed: Oct. 24, 1986

[51] Int. Cl.[4] ..... A63F 9/14

[52] U.S. Cl. ..... 273/86 R; 273/138 A

[58] Field of Search ..... 273/86 R, 86 A, 138 R, 273/138 A, 139, 246; 119/29

[56] References Cited

U.S. PATENT DOCUMENTS

| | | | |
|---|---|---|---|
| 2,010,558 | 8/1935 | Neuzil . | |
| 2,631,041 | 3/1953 | Zaichick . | |
| 2,654,163 | 10/1953 | Reynolds . | |
| 3,417,995 | 12/1968 | Creely . | |
| 3,462,151 | 8/1969 | Parisi . | |
| 3,556,530 | 1/1971 | Barr et al. | 273/139 |
| 3,770,271 | 11/1973 | Kim | 273/86 R |
| 3,998,465 | 12/1976 | Mascola | 273/139 |
| 4,019,737 | 4/1977 | Witzel | 273/94 |
| 4,033,587 | 7/1977 | Oliver | 273/86 G X |
| 4,043,557 | 8/1977 | Johnston | 273/86 R |
| 4,082,289 | 4/1978 | Merritt | 273/246 |
| 4,141,548 | 2/1979 | Everton | 273/1 E |
| 4,199,147 | 4/1980 | Stansberry | 273/246 |
| 4,586,707 | 5/1986 | McNeight et al. | 273/1 R |
| 4,651,678 | 3/1987 | Kime | 119/29 |

OTHER PUBLICATIONS

"Ainslie's Complete Guide to Thoroughbred Racing" by Tom Ainslie, publ. by Simon & Schuster, N.Y., Copyright 1968, p. 406.

"Scarne's New Complete Guide to Gambling" by John Scarne, publ. by Simon & Schuster, N.Y., Copyright 1974, pp. 174, 175.

"Kentucky Derby Stakes" Lottery Ticket, 3 pages, 1976.

"Let's Go To The Races", Television Game, Circa. 1950's.

*Primary Examiner*—Anton O. Oechsle

*Attorney, Agent, or Firm*—Oblon, Fisher, Spivak, McClelland & Maier

[57] ABSTRACT

A method of conducting a racing event and a hybrid sporting event and game show based on the sporting event. Robotic jockeys are used to control racing animals, preferably miniature horses or Hackney ponies, in a racing event made up of one or more races. Players holding race cards that contain pairings of a race identification and an indicium identifying an animal in the corresponding race. The players may win individual races or the entire event or both, depending upon the outcome of the races, the content of the race cards held by the players, and other factors. The animal-identifying indicium borne by each animal may be selected by chance prior to each race. Race cards may be distributed in advance of the event, either at the racing facility where the event is held, at remote locations such as supermarkets, or both. The event may be broadcast live, and winners may be present at the event, or in the broadcast audience, or both.

19 Claims, 2 Drawing Sheets

HYBRID SPORTING EVENT AND GAME SHOW

BACKGROUND OF THE INVENTION

1. Field of the Invention

The invention relates to a method of conducting a racing event and to a hybrid sporting event and game show.

2. Discussion of the Background

It has been known to race animals, especially horses, dogs and the like, in events in which observers, or players, have a stake in the outcome and who also observe the event for entertainment.

More recently, there has been developed a remote control apparatus for controlling animals, referred to herein as a robotic jockey. Such apparatus comprises a remote control operated by a human operator and a controlling unit mounted on the animal. Examples of robotic jockeys are disclosed in U.S. Pat. No. 4,304,193 of Madden and U.S. patent application No. 792,858 of Kime, filed Oct. 30, 1985, now U.S. Pat. No. 4,651,678 the disclosures of which are hereby incorporated by reference.

SUMMARY OF THE INVENTION

The invention includes a method of conducting a racing event and a hybrid sporting event and game show based on the sporting event. Robotic jockeys are used to control racing animals, preferably miniature horses or Hackney ponies, in a racing event made up of one or more races. Players hold race cards that contain pairings of a race identification and an indicium identifying an animal in the corresponding race. The players may win individual races or the entire event, or both, depending upon the outcome of the races, the content of the race cards held by the players, and other factors. The animal-identifying indicium borne by each animal may be selected by chance prior to each race. Race cards may be distributed in advance of the event, either at the racing facility where the event is held, at remote locations such as supermarkets, or both. The event may be broadcast live, and winners may be present at the event, or in the broadcast audience, or both.

DETAILED DESCRIPTION OF THE PREFERRED EMBODIMENTS

Figure 1:
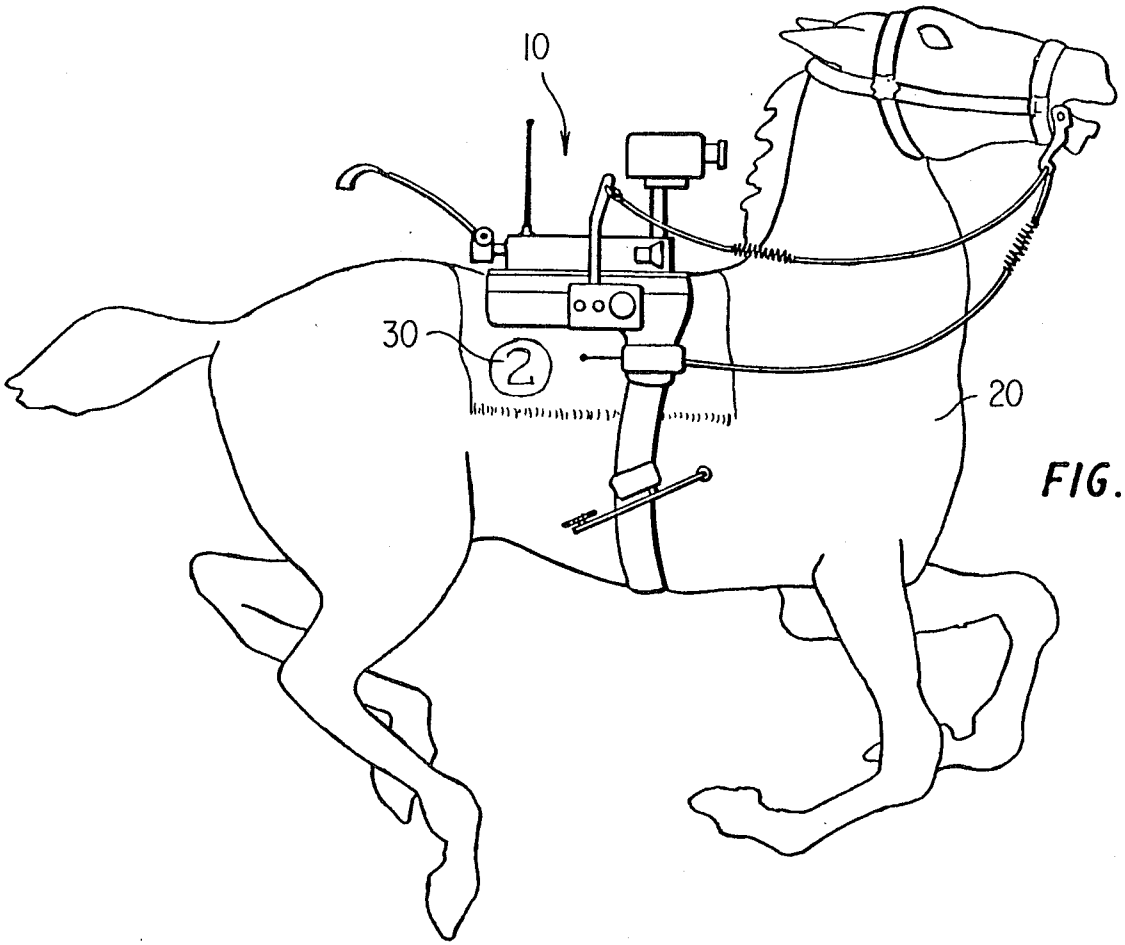
FIG. 1 PRIOR ART
FIG. 1 is a vertical elevation of a controlling unit of a robotic jockey mounted on a horse.

FIG. 1 shows an exemplary controlling unit 10 of a suitable robotic jockey, the controlling unit being mounted on an animal 20. Preferably, animal 20 is a horse but may be any animal suitable for racing. Most preferably, animal 20 is either a miniature horse or a Hackney pony. A miniature horse, according to accepted breeder definition, is a horse having a height of no more than thirty-four inches at the withers and not exhibiting any evidence of dwarfism.

Miniature horses were used long ago for drawing small carriages and for work in mine tunnels. More recently, they have been bred for show and for pets. But miniature ponies and Hackney ponies are too small to be ridden by adult jockeys, and the Hackneys are too spirited for a child to manage. However, with the development of the comparatively light-weight robotic jockey, the inventor conceived the idea of racing these animals and has found that they are excellent racers and can be well controlled by using a robotic jockey according to the above-cited patent application of Kime.

An additional advantage of using a robotic jockey and miniature horses or Hackney ponies is that, in comparison to racing full-size horses such as thoroughbreds, more races may be conducted in the same period of time. A preferred format according to the current invention is to conduct eight races within an hour, a feat that would be very difficult using standard racing horses and human jockeys.

Also shown in FIG. 1 is animal-identifying indicium 30, which may be a number, as shown, or may be any other means of visual identification such as a color, a combination of colors, a pattern, or the like. The animal-identifying indicium 30 is distinct for each horse in a race of an event.

An event is made up of at least one, preferably more, races. Currently, the inventor prefers to conduct eight races of five horses each. The race may be of any kind that is conducted between a start and a finish. Even steeplechase races are possible; the inventor has found that miniature horses wearing robotic jockeys can be made to jump hurdles.

Figure 2:
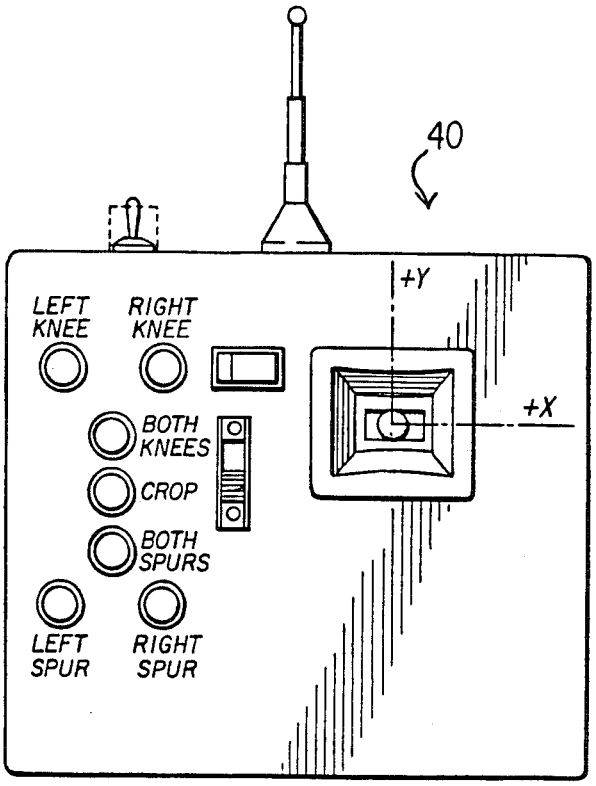
FIG. 2 PRIOR ART
FIG. 2 is a plan view of a remote control of a robotic jockey.

During each race, the actions of the animal are controlled by an operator by using a remote control 40, an example of which is illustrated in FIG. 2.

Figure 3:
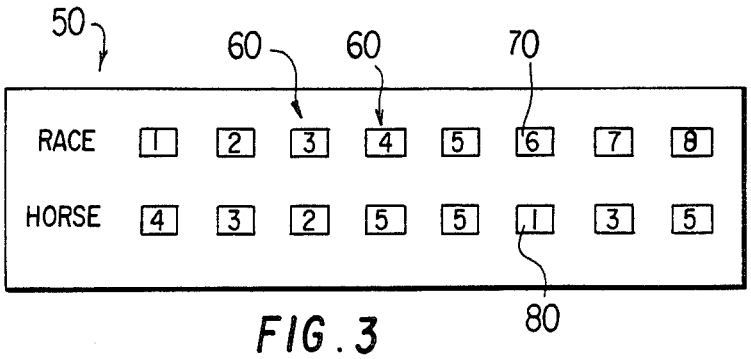
FIG. 3 illustrates an example of a race card according to the current invention.

Shown in FIG. 3 is a race card 50 according to the current invention. Pre-printed on each of a plurality of race cards 50 are one race pairing 60 for each race to be run in the event. In the example shown, there are eight race pairings 60 corresponding to eight races in an event.

Each race pairing 60 comprises a race-identifying indicium 70, which preferably is a number used to identify a particular one of the races, and an animal-identifying indicium 80 which is one of the animal-identifying indicia that will be borne by the animals during the race. For convenience, these indicia will be called the race number and the horse number, respectively.

The race cards 50 preferably are distributed to players in advance of the event. Players attending the event may receive one or more race cards upon their arrival. More preferably, the race cards are distributed for a number of days in advance of the event at locations remote from the racing facility where the event will be held, such as retail stores and other commercial establishments. For example, one or more race cards may be given to a retail customer.

Preferably, the event is broadcast live to an audience, as by radio, over-the-air television and, most preferably, cable television. Because a player may be among the audience rather than in attendance at the event, a race card holder may watch the event in real time at a remote location and determine if he is a winner.

Because the horse numbers 80 are pre-printed on the game cards 50, winning a race involves no measure of predictive skill on the part of the player. In addition to the possibility of holding a winning race card, further interest may be added by injecting into the game additional elements of uncertainty. In particular, before each race, the particular horse number to be borne by each horse in the race may be selected by any process designed to randomize the selection, such as a drawing.

It will be understood that the word "randomize" is here used to describe any process that will assure that the selection is heavily influenced by chance, and that the word is not intended to be confined to its more narrow mathematical definition.

An additional advantage of such a procedure is that, where one of the horses is known to be a favorite, the selection of the number for that horse will itself be a matter of particular interest for the race card holders. Accordingly, it is desirable for the selection to be accomplished in such a manner as to be witnessed by the players and for the resulting matchings of number and horse to be announced.

Preferably, a starting gate is provided for the horses, and there may be added an even further element of uncertainty and interest by assigning the positions in the gate by a similar process designed to randomize the selection of starting position. When the animal-identifying indicia are numbers that correspond to gate positions, the same drawing or other process can be used both to assign the numbers to the horses and the horses to the gates. For example, the number one horse would start in the most-advantageous number one gate, and so forth.

Typically, prizes of varying value will be given, including one grand prize. In such a case, it is desirable to provide that the plurality of race cards can produce only one winner of the entire event. In such a case, only one race card may bear the number of the winning horse in every race. To achieve such a result, each race card must be unique.

For example, if an event is made up of eight races of five horses each, there can be produced five to the eighth power (390,625) unique race cards such that only one of those race cards will bear the number of the winning horse in every race. After the results of the event are known, this one race card will be declared to be the event-winning race card. Accordingly, the holder of this race card (assuming it has been given out during the distribution of the race cards) is declared the winner of the event and is awarded the grand prize.

If desired, it may be required that the holder of the event-winning card (or of any other lesser winning card, as described below) be present to win. Preferably, because it is contemplated that the event be broadcast, the holder need not be present to win. If no holder of the event-winning race card is identified, the winner of the event may be chosen by a drawing or by a post-event run-off race, possibly on a later date.

Race cards that have been declared to be winning race cards for some but not all of the races of an event may be declared second and third place winning race cards. For example, second place winning race cards may be declared to be those bearing the numbers of seven winning horses out of eight. Furthermore, prizes may be awarded to holders of race cards which have been declared winning race cards for a predetermined number of races in a row.

What is claimed as new and desired to be secured by Letters Patent of the United States is:

1. A method of conducting a racing event comprising the steps of:

providing a racing facility;

providing a plurality of animals, each animal bearing a distinct animal-identifying indicium;

providing a controlling unit of a robotic jockey mounted on and controlling each animal;

providing remote control means of the robotic jockeys for controlling each of the controlling units;

providing a plurality of race cards, each race card bearing a plurality of race pairings, each race pairing including a race-identifying indicium and a corresponding indicium which is one of said animal-identifying indicia, no two of said race cards bearing identical race pairings for every race of the event;

distributing to each of a plurality of players at least one of said race cards;

using the remote control means and controlling units to conduct a racing event comprising a plurality of races of at least two of said animals from a start to a finish;

for each race of the event, declaring one of said animals to be the winner of the race;

for each race of the event, declaring every race card to be a winning race card for the race which bears a race pairing corresponding to the race that includes an animal-identifying indicium matching the animal-identifying indicium borne by the winning animal;

declaring an event-winning race card to be a card which has been declared to be a winning race card for every race of the event.

2. The method of claim 1, wherein said step of providing a plurality of animals comprises the step of providing a plurality of horses.

3. The method of claim 2, wherein said step of providing a plurality of horses comprises the step of providing a plurality of miniature horses.

4. The method of claim 2, wherein said step of providing a plurality of horses comprises the step of providing a plurality of Hackney ponies.

5. The method of claim 1, wherein said step of providing a plurality of animals bearing animal-identifying indicia comprises the step of selecting the indicium to be borne by each animal by a process designed to randomize the selection.

6. The method of claim 5, further comprising the step of announcing the results of said selection to the players prior to said at least one race and after the distribution of the race cards.

7. The method of claim 5, wherein said step of selecting the animal-identifying indicia comprises the step of conducting said selection in a manner so as to be witnessed by the players.

8. The method of claim 1, further including the steps of providing a starting gate and selecting the positions of the animals in the starting gate by a process designed to randomize the selection.

9. The method of claim 8, further comprising the step of announcing the results of the selection to the players prior to said at least one race and after the distribution of the race cards.

10. The method of claim 8, wherein said step of selecting the positions of the animals in the starting gate comprises the step of conducting said selection in a manner so as to be witnessed by the players.

11. The method of claim 1, further comprising the step of broadcasting the event to an audience.

12. The method of claim 11, wherein the audience includes at least some of the players.

13. The method of claim 1, wherein said step of distributing race cards includes the step of distributing at least some of said race cards to at least some of said players at least one location other than said racing facility.

14. The method of claim 1, further comprising the step of declaring an event-winning race card to be a card which has been declared to be a winning race card for every race of the event.

15. The method of claim 14, further comprising the step of declaring an event-winning player to be a player who is a holder of an event-winning race card.

16. The method of claim 14, further comprising the step of declaring an event-winning player to be a player who is both present at the event and a holder of an event-winning race card.

17. The method of claim 14, further comprising the step of declaring a second place winning race card to be a race card that has been declared to be a winning race card for a predetermined number of races that is less than the total number of races of the event.

18. The method of claim 17, further comprising the step of declaring a second place winning player to be a player who is a holder of a second place winning race card.

19. The method of claim 17, further comprising the step of declaring a second place winning player to be a player who is both present at the event and a holder of a second place winning race card.

* * * * *